US006368414B1

(12) United States Patent
Johnson

(10) Patent No.: US 6,368,414 B1
(45) Date of Patent: Apr. 9, 2002

(54) WASHING PARTS WITH ULTRASONIC ENERGY

(76) Inventor: Walter Johnson, 1311 14th Ave., Belvidere, IL (US) 61008-5461

( * ) Notice: Subject to any disclaimer, the term of this patent is extended or adjusted under 35 U.S.C. 154(b) by 0 days.

(21) Appl. No.: 09/334,755

(22) Filed: Jun. 17, 1999

(51) Int. Cl.[7] ..... B08B 3/12

(52) U.S. Cl. ..... 134/1; 134/65; 134/132; 134/184

(58) Field of Search ..... 134/1, 23, 25.5, 134/32, 33, 37, 65, 132, 184

(56) References Cited

U.S. PATENT DOCUMENTS

| | | | | |
|---|---|---|---|---|
| 2,845,077 A | | 7/1958 | Branson | |
| 2,973,312 A | | 2/1961 | Logan | |
| 3,078,860 A | | 2/1963 | Rand | |
| 3,106,928 A | | 10/1963 | Rand | |
| 3,440,094 A | | 4/1969 | Adam et al. | |
| 3,498,839 A | | 3/1970 | Mehta | |
| 3,754,559 A | * | 8/1973 | Seiwert | 134/65 |
| 3,849,195 A | | 11/1974 | Powell, Jr. et al. | |
| 4,057,070 A | | 11/1977 | van Amerongen et al. | |
| 4,170,241 A | | 10/1979 | Clapp | |
| 4,170,488 A | | 10/1979 | Norman | |
| 4,173,493 A | * | 11/1979 | Kallas | 134/11 |
| 4,200,470 A | | 4/1980 | Pennekamp | |
| 4,344,448 A | * | 8/1982 | Potts | 134/184 |
| 4,372,787 A | * | 2/1983 | Fields et al | 134/1 |
| 4,788,992 A | * | 12/1988 | Swainbank et al. | 134/1 |
| 5,114,494 A | | 5/1992 | Remec | |
| 5,853,013 A | * | 12/1998 | Busick et al. | 134/63 |

* cited by examiner

*Primary Examiner*—Randy Gulakowski
*Assistant Examiner*—Saeed Chaudhry
(74) *Attorney, Agent, or Firm*—Quarles & Brady, LLP

(57) ABSTRACT

This invention relates to a continuous ultrasonic washing method and apparatus for small parts in manufacture. It more particularly relates to washing small manufacture parts in an apparatus requiring small volumes of water, no cleaning detergents, and an efficient ultrasonic transducer system where the ratio of ultrasonic power per volume of water is at a level well above that for other ultrasonic washers in use today.

17 Claims, 4 Drawing Sheets

FIG. 4
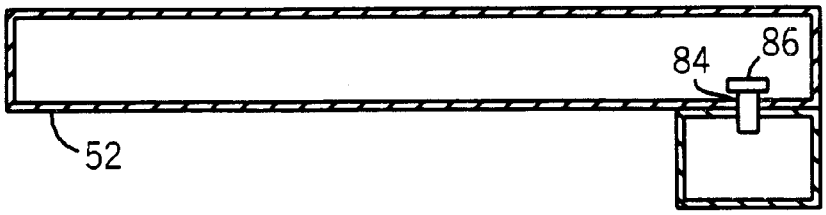
FIG. 5
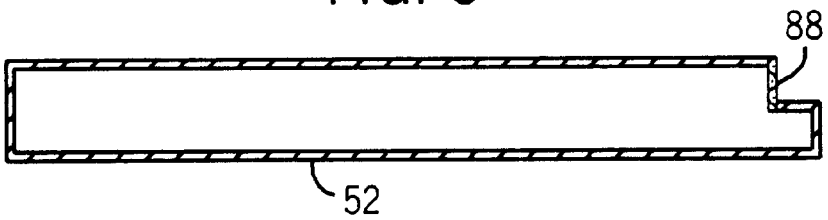
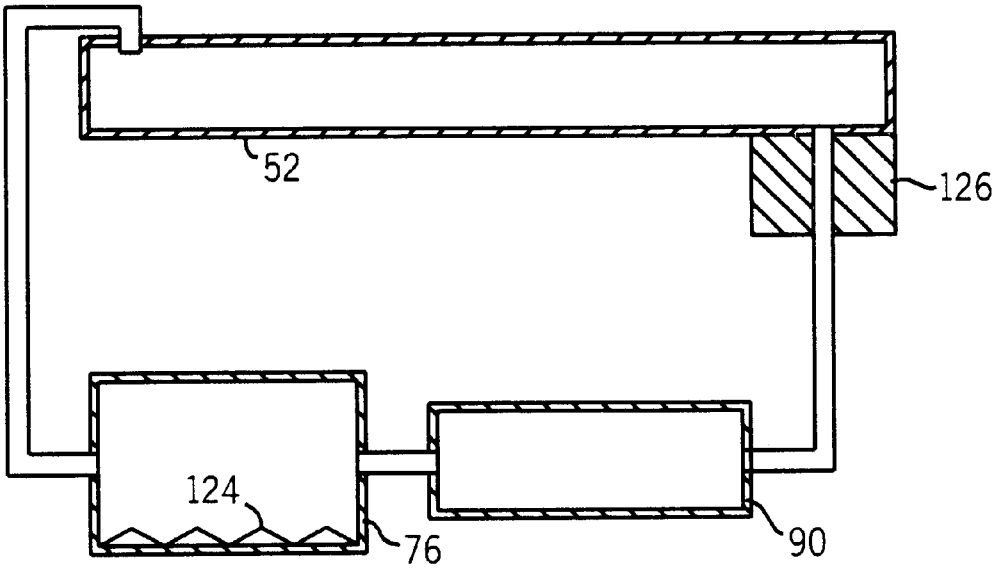
FIG. 6

WASHING PARTS WITH ULTRASONIC ENERGY

CROSS-REFERENCE TO RELATED APPLICATIONS

This application claims the benefit of U.S. Provisional Application No. 60/089,537, filed Jun. 17, 1998.

STATEMENT REGARDING FEDERALLY SPONSORED RESEARCH OR DEVELOPMENT

Not applicable.

BACKGROUND OF THE INVENTION

In industrial processes in which complex assemblies are made from a variety of small parts, whether made on site or packaged and shipped from elsewhere, parts washers are commonly used to wash individual parts so that they are free of dirt and oil and will fit smoothly in the assembly process. Generally, these parts washers fall into one of two categories, batch-type washers or continuous flow washers. Batch-type washers require parts to be washed batch-by-batch, while continuous washers allow for a continuous flow of parts through a washing apparatus without disrupting the flow of an assembly line, Most parts washers operate using aqueous solutions or solvent based cleaning strategies. Typical cleaning strategies depend upon the interaction of three factors: heat, force and chemistry. In the case of aqueous Cleaning technology, force is the dominant factor, while chemistry and heat play supporting roles. In aqueous cleaning processes, chemical detergents are applied to penetrate the dirt or oil found on the surface of a part, in order to wet the underlying part surface. Heat, on the other hand, is used to speed up the rate to which chemical detergents react with or penetrate the dirt or oil, while, at the same time, thinning out the dirt or oil by reducing its viscosity. An ample amount of force is then applied to effectively wash the oil or dirt from the part's surface. In the absence of chemical detergents or heat, a substantial force is necessary to break the oil or dirt away from a part's surface. Often times, this results in ineffective cleaning or the consumption of substantial amounts of energy. On the other hand, the use of chemical detergents results in dirt or oil being more easily removed with less force being necessary. Unfortunately, these chemical detergents are often expensive and toxic to nature. In today's industry, most, if not all, continuous flow-type parts washers are based on the use of detergents or other solvents.

The force applied in aqueous cleaning strategies may be by either a high pressure spray or ultrasonic energy. In prior art ultrasonic cleaning systems, ultrasonic transducers produced ultrasonic pressure waves which, when coupled to a liquid medium, causes dirt and oil to be dislodged from parts bathed in an aqueous solution. In order to be effective, however, typically this requires either a significant force or an aqueous solution of chemical detergents and heat as described above.

One ultrasonic washer in use today places manufacture parts to be cleaned in baskets which are moved through an ultrasonic field (U.S. Pat. No. 2,845,077). A disadvantage of this method is that parts which are located in the shadow of other parts in the ultrasonic field receive significantly weaker exposure to ultrasonic energy than those which are directly exposed to the ultrasonic energy. Other ultrasonic washers have attempted to solve this problem by introducing various ultrasonic continuous flow-type washing methods and devices which are intended to enhance the exposure of the manufacture parts to the ultrasonic field. One washer includes a tank where parts sink vertically against the upward flow of a cleaning solution to a bottom where an auger drives the parts up out of the solution and into a collection hopper (U.S. Pat. No. 2,973,312). Another washer utilizes a vibratory surface, placed within a cleaning solution, which serves as a conveyor belt to move parts through the cleaning solution and as a means of creating ultrasonic energy (U.S. Pat. No. 4,194,922). A third apparatus moves bearings through an ultrasonic force by a stationary conveyor mechanism housed in a reservoir containing a cleaning solution where the force cleans and moves the bearings along (U.S. Pat. No. 4,057,070).

In all these cases, the ultrasonic force is generated from outside of the reservoir containing the parts and the aqueous cleaning solution. Because of this, the ultrasonic energy must pass through a coupling medium, usually water, and/or the walls enclosing the cleaning reservoir before it can couple with the aqueous cleaning solution, usually containing a chemical detergent, and effectively clean the manufactured parts. The distance this energy must travel and the several elements it must travel through, in turn, decreases the strength of the ultrasonic force available to effectively clean the manufacture parts. In order to rectify this problem, either a substantial chemical detergent, a significant amount of heat, or a strong ultrasonic energy wave generated by relatively high energy transducers must be employed to achieve the desired degree of cleaning. Of course, this will result in substantial cost and inefficiencies, including the additional expense of purchasing and disposing of cleaning detergents and the increased cost of electricity for generating heat or ultrasonic energy.

BRIEF SUMMARY OF THE INVENTION

The method and apparatus of the present invention is summarized in that a novel method for cleaning manufacture parts using an ultrasonic continuous flow-type process is disclosed. The present invention is further summarized in that it provides for a method of washing small manufacture parts in an apparatus requiring small volumes of water, no cleaning solutions, and an ultrasonic transducer system wherein the ratio of ultrasonic power per volume of water is at a level well above that for other ultrasonic washers in use today.

More specifically, disclosed is a method and apparatus comprising washing small manufacture parts in an apparatus requiring no cleaning solutions, wherein soiled parts are segregated and passed singly along through a feeding mechanism, and into a cleaning station such that the parts are immersed in a small volume of hot water and passed through an ultrasonic field generated by one or more ultrasonic transducers placed in close proximity to the moving parts and located within the small volume of water, until they are passed up another tapered collar and out of the hot water where they travel through a rinsing station and a drying station. The feeding mechanism then moves the parts out of the ultrasonic washer and onto other applications.

It is an object of the present invention to provide an ultrasonic continuous flow-type parts washer which uses a small volume of water, no cleaning solutions, and an efficient ultrasonic transducer system where the ratio of ultrasonic power per volume of water is at a level well above that for other ultrasonic washers in use today.

It is another object of the present invention to provide a feeding mechanism for a continuous flow-type parts washer that allows the introduction of soiled manufacture parts into an aqueous solution so that ultrasonic energy can be coupled through the solution, while still moving the parts out again and onto further applications.

The foregoing and other objects and advantages of the invention will appear from the following description. In the description, reference is made to the accompanying drawings which form a part hereof and in which there is shown by way of illustration, a preferred embodiment of the invention. Such embodiment does not necessarily represent the full scope of the invention, however, and reference must be made therefore to the claims herein for interpreting the scope of the invention.

BRIEF DESCRIPTION OF THE SEVERAL VIEWS OF THE DRAWINGS

FIG. 4 is a sectional view in side elevation exposing the upper reservoir containing an adjustable bottom flowing drain.

FIG. 5 is a sectional view in side elevation exposing the upper reservoir containing a skimmer trough.

FIG. 6 is a sectional view in side elevation exposing the upper reservoir containing a time adjustable solenoid drain connected to the clean water reservoir through a filter system.

DETAILED DESCRIPTION OF THE INVENTION

Figure 1:
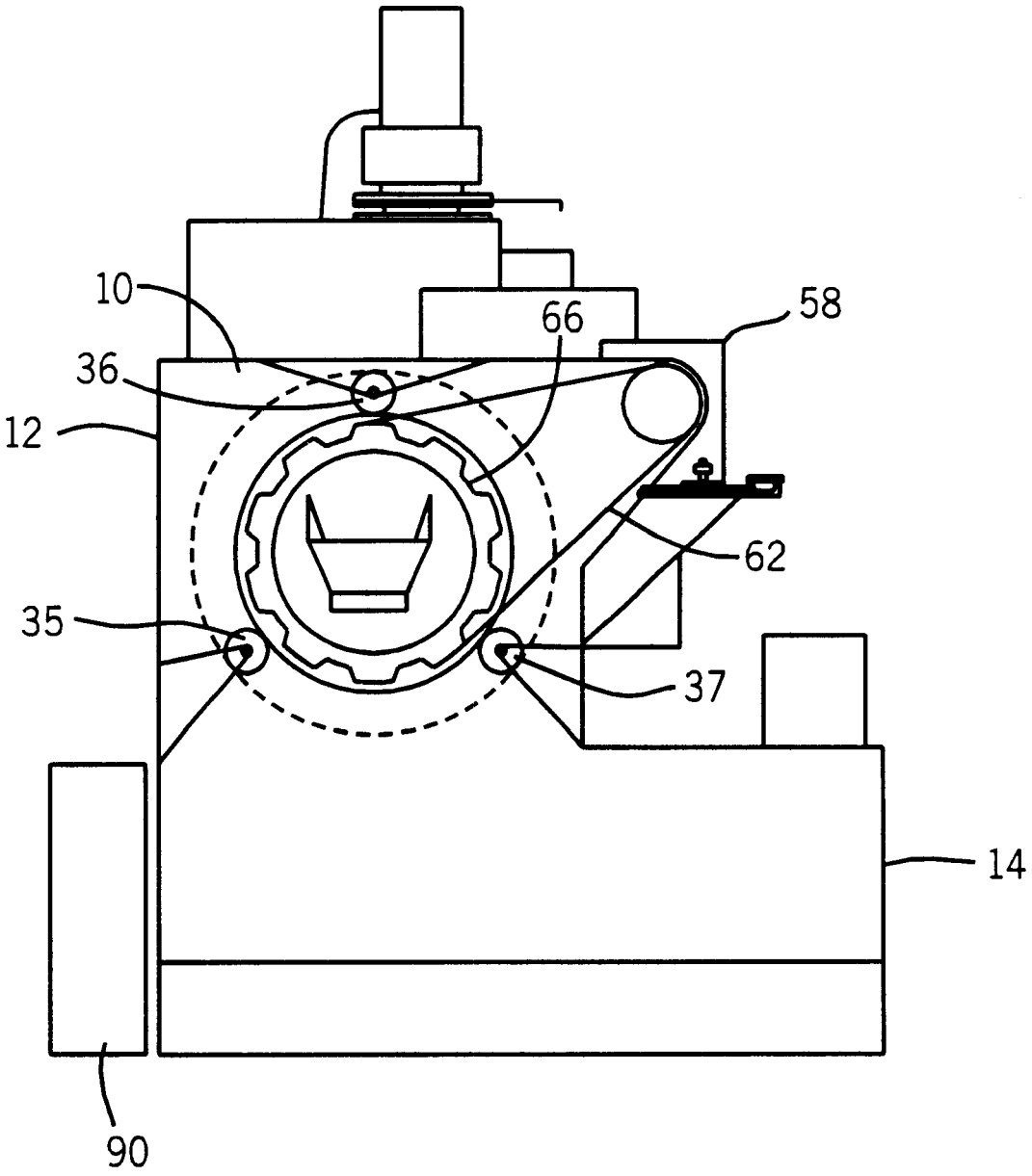
FIG. 1 is a diagrammatic illustration showing the end view of the cleaning apparatus.

The present invention is directed toward an ultrasonic parts washer capable of use in a continuous flow through process. The device is generally illustrated in FIGS. 1 through 6. More specifically, as shown in FIG. 1, a continuous washer 10 is shown which has a drum portion 12 sitting on top of a tank portion 14.

The present invention is also directed toward a method of cleaning parts using ultrasonic energy located in a water bath very Close to the parts being cleaned, The intensity of the application of ultrasonic energy makes it possible to clean parts in pure water, without the need for solvents, detergents or other chemicals.

Figure 2:
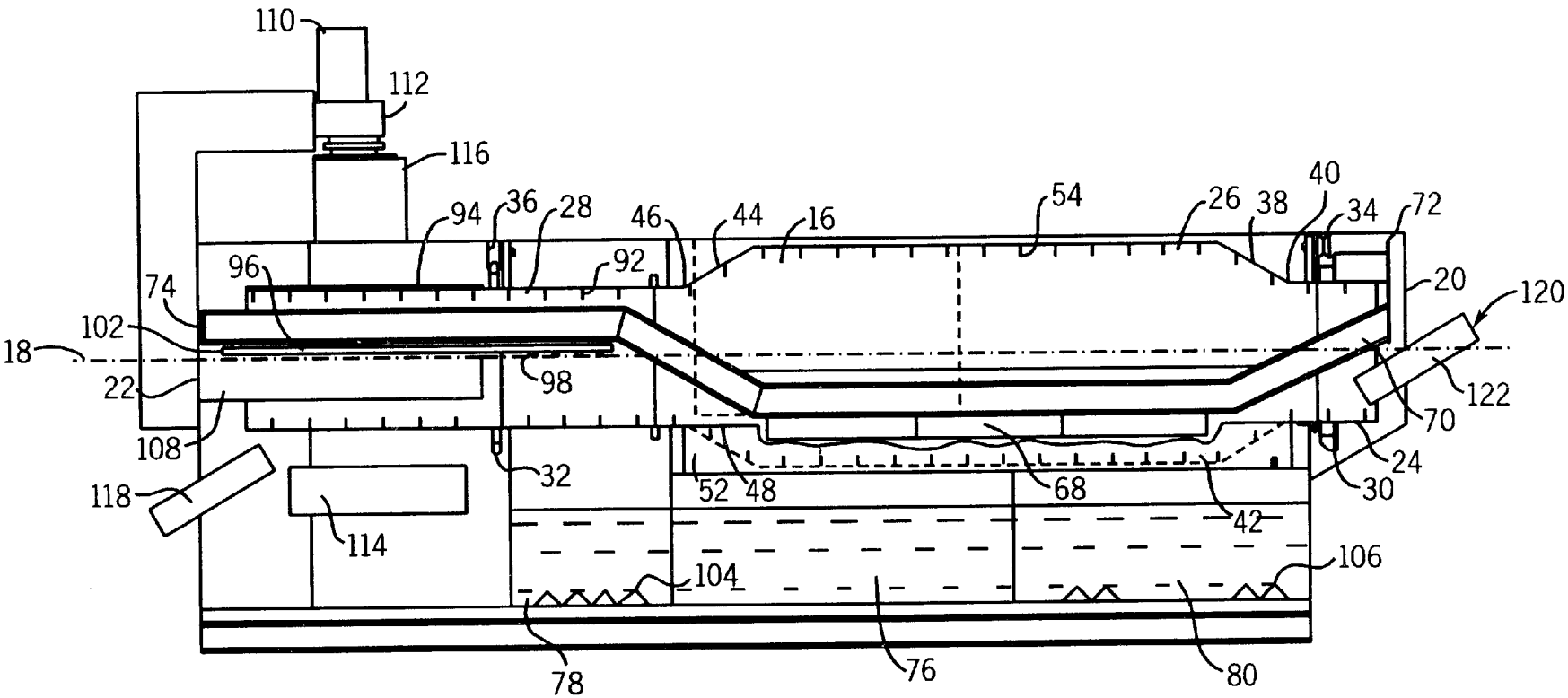
FIG. 2 is a diagrammatic illustration showing the cross-sectional side view of the cleaning apparatus.
Figure 3:
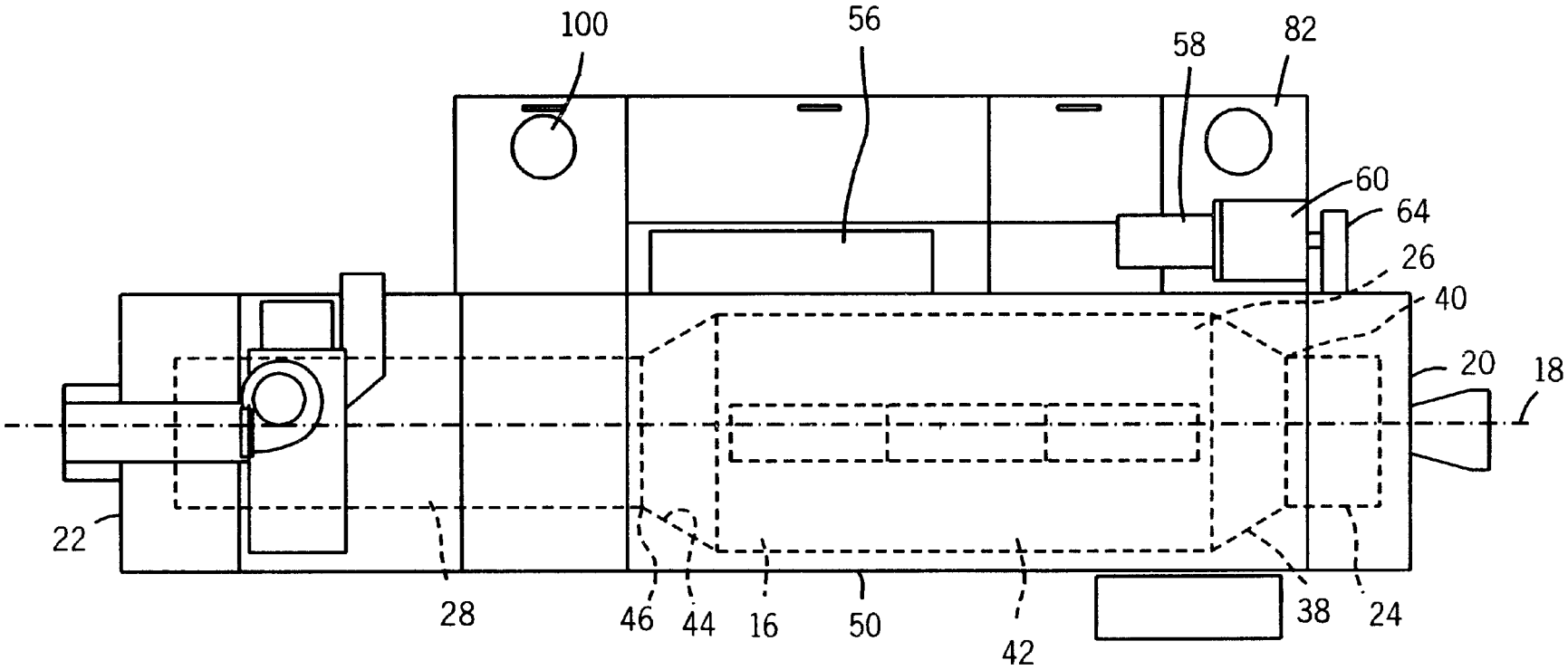
FIG. 3 is a diagrammatic illustration showing the top view of the cleaning apparatus.

Referring to FIGS. 2 and 3, an elongated cylindrical drum 16, extending longitudinally and centrally through drum portion 12 is supported for rotation about its fixed longitudinal axis 18, wherein the axis 18 is set in the washer along a horizontal plane. The drum 16 extends from a feeding end 20 to an exit end 22 and includes a perforated entry drum section 24, a perforated middle section 26, and perforated exiting drum section 28. Longitudinally spaced apart along the drum 16 are two supporting rings 30 and 32, as shown in FIG. 2, forming as v-shaped flanges shaped to ride within two sets of supporting rollers 34 and 36. The supporting rollers 34 and 36 each include three v-rollers, although only one roller is illustrated by rollers 34 and 36 in FIG. 2. The rollers 34 and 36 are placed above the drum 16 along the drum 16 vertical midplane and the two other rollers, as illustrated by rollers 35 and 37 in FIG. 1, are placed below the drum 16 on opposite sides of the drum 16 vertical midplane from each other to form a triangle wherein each roller is equidistant from one another. Each roller is mounted to a cabinet 50 forming the housing for the drum portion 12 so as to allow rotation of the v-rollers and provide support for the rotational motion of drum 16.

Referring to FIGS. 2 and 3, the perforated middle section 26 has a first narrow collar 38, proximal to its attachment point 40 to drum section 24, tapering down outward into a cleaning station 42 and a second narrow collar 44, proximal to its attachment point 46 to drum section 28, tapering inward from the cleaning station 4. As shown in FIG. 2, each attachment point 40 and 46 lies above the level of a liquid (or water) bath 48 contained within an upper reservoir 52. A wash water bath sits below the drum 16 with the lowest portion of the cleaning station 42 of the drum sitting in the wash water. The wash water is preferably just pure water, rather than water with a chemical or detergent added. The lower section cleaning station 42 of drum section 26 thus lies below the surface level of the liquid bath 48 such that parts resting in the cleaning station 42 of the drum 16 will be completely submerged within the liquid bath. The drum 16 is provided throughout its interior with flutes or flights 54 on its interior surfaces. These flights 54 are helical or spiral in configuration so that the rotation of the drum 16 constantly carries the manufacture parts from the feeding end 20 to the exit end 22 as the drum 16 rotates.

A run switch box, not shown, and other electrical controls, not shown, are set within a control box 56 illustrated in FIG. 3, mounted to the cabinet forming the housing 50 of the washer. Referring to FIGS. 1 and 3, the run switch box is connected to an electric motor 58 which operates a drum drive chain 60 connected by a sprocket pinion, not shown, to a sprocket chain, 62, housed in a sprocket chain guard 64. The sprocket chain 62 is connected to the drum 16 by a drum sprocket wheel 66 attached to the drum section 24 at the entry end 20, allowing the chain drive to unidirectionally rotate the drum 16 at a variable rate of speed.

Referring to FIG. 2, one or more (here three) ultrasonic transducers 68, are attached to a mounting bar 70 which extends along the longitudinal axis of the drum 16 through both the entry end 20 and exit end 22, where it is attached to the frame of the washer housing 50 at attachment points 72 and 74. The mounting bar 70 is shaped to traverse through the entire length of the drum 16, such that at least a portion of the transducers 68 are below the level of the liquid bath 48 in the upper reservoir 52, and located at a defined distance away from the manufacture parts progressing through the cleaning station 42. The defined distance between the parts and the transducer is typically about one inch for durable metal parts and about zero to six inches for other types of parts. The transducers 68 are connected to the control box 56 by electrical wiring, not shown, which traverses along the mounting bar 70 and are set to run upon activation of the run switch box contained within control box 56. The output of ultrasonic power supplied by the ultrasonic transducers 58 is further controlled by controls located in the control box 56 so as to vary the degree of ultrasonic cavitation in the cleaning station 42.

As shown in FIG. 2, the tank portion 14 is divided to contain a clean liquid reservoir 76, a rinse liquid reservoir 78 and a dirty liquid reservoir 80. The clean liquid reservoir 76 is connected to the upper reservoir 52 through a pump 82, shown in FIG. 3, which may either continuously replace the liquid bath contained within the upper reservoir 52 or replace said liquid bath on a time basis. The upper reservoir 52 includes a drain which allows the disposal of the dirty liquid bath generated by the cleaning of parts passing through the drum 16. As shown in FIG. 4, the drain may include an adjustable bottom flowing drain comprising of a jack screw 86 or a weir dam such that the dirty liquid bath and any unwanted particles are displaced into the dirty liquid reservoir 80 by an opening 84 created by the adjustment of the jack screw 86 or weir dam. As shown in FIG. 5, the drain includes a skimmer trough 88 designed to remove a froth composed of washing material, oil, and other soils, which forms, rises and floats longitudinally across the surface of the body of the cleaning liquid to the skimmer trough 88 where it empties into the dirty liquid reservoir 80. As shown in FIG. 11 the dirty liquid reservoir 80 is constructed to collect the dirty liquid bath drained from the upper reservoir 52 where it is pumped through a filter system 90, shown in FIG. 1, and back into the clean liquid reservoir 76.

The exiting section 28 of the drum 16 is divided so as to define a rinsing station 92 located immediately posterior to the cleaning station 42 and a hot air drying station 94 located immediately posterior to the rinsing station 92. Within the rinsing station 92, a longitudinal spray manifold 96 carries a set of spray station nozzles 98 for spraying hot cleaning liquid on the parts. The spray manifold 96 is supplied with cleaning liquid by a constantly running electric pump 100 having its output connected to the spray manifold 64 by a water line, not shown, which draws from the rinsing liquid reservoir 78. The rinsing liquid reservoir 78 is constructed to collect the hot cleaning liquid sprayed by the spray manifold 96 where heating elements 104 maintain the cleaning liquid at a constant temperature until it is recirculated back into the rinsing station.

The heating elements 104 consist of a side by side series of longitudinal heating elements, or a single such resistance-heating element as necessary, fitted to the bottom of the rinse reservoir 78. A second series of side by side longitudinal heating elements 106, or a single such resistance-heating element as necessary, is fitted to the bottom of the dirty liquid reservoir 80 and used to maintain the temperature of the cleaning liquid circulated into the upper reservoir 52 and into the wash cycle. Each series of elements contains an adjustable source of electric, gas fired or steam supplied heat, which is thermostatically controlled within the control box 56 to regulate the temperature of the elements.

An outlet duct 108 of a compression system 110 establishes the hot drying station 74 in the exiting section 28. The compression system 110, containing a multi-bladed air rotor of the squirrel cage type, not shown, which is rotatably supported by the electric motor, not shown, in the compression section of the compressor 112, draws air from a chamber lying below the drum 16 of the hot drying station 94 through an inlet duct 114 and into an air heater 116 which is thermostatically controlled within the control box 56 to regulate the temperature of the hot drying air. The hot air is drawn out of the air heater 116 and forced by the blower, not shown, of the compression system 110 through the outlet duct 108 and onto the parts in the hot drying station 94 where it is once again taken up by inlet duct 114.

Immediately posterior to the hot drying station 94, the drum 16 opens into the exiting end 22 containing an exiting chute 118. The parts pass through the exiting end 22 and tumble down the exiting chute 118 where they may be collected or conveyed onto further processes.

Prior to operation, the rinsing reservoir 76, clean liquid reservoir 78, upper reservoir 52 and dirty liquid reservoir 80 are filled with a cleaning liquid and brought to an ideal temperature by the heating elements 104 and 106. In the preferred embodiment of the present invention, water is the sole cleaning liquid used throughout the cleaning process, although, any cleaning solution may be employed. It is one particular advantage of the present invention that no detergents are necessary to produce an effective cleaning of manufacture parts. The sole purpose of cleaning detergents used in cleaning solutions is to penetrate the dirt and oil in order to wet the underlying surface so as to allow the washing force to wash away the dirt and oil. In the present invention, such cleaning detergents are not necessary due to the high level of force generated by the ultrasonic transducers. Water temperature assists in the cleaning process by thinning out the oil and dirt through reduction of viscosity. This speeds up the rate of cleaning and expands the area of application, but it is not necessary to the process. Good cleaning of soils can be done at ambient temperatures, but in practice, a high rate of cleaning can be achieved by raising the temperature of the water to a temperature ranging between 160° F. and 180° F.

In its operation, the run switch box is set to run the electric motor 58 which turns the drum 16 and, at the same time, is activates the electronic ultrasonic transducers 68, the electric pumps 82 and 100, the heating elements 104 and 106, and the hot air drying compression system 110. The manufacture parts to be cleaned are fed into the drum 16 at its entry end 20, as shown by an arrow 120, down a charging chute 122 which is in the mouth of the central opening to the entry end 20 and the entry drum section 24. The flights 54, by the rotation of the drum 16, move the parts horizontally in the direction of the exit end 22. The rate at which the parts are passed through the washer 10, and thus their exposure to the ultrasonic field in the cleaning station 42 and the rinsing and drying stations 92 and 94, may be adjusted by a control found in the control box 56, shown in FIG. 3, which alters the speed in which the electric motor 58 turns the drum drive chain 60 rotating the sprocket pinion, not shown, which turns the sprocket chain 64 and rotates the drum 16. The slower the electric motor 58 operates, the slower the drum 16 rotates and the slower the flights 54 pass the parts through the drum 16. In the preferred embodiment the exposure time may vary from a number of seconds to a few minutes depending on the desired rate of part cleaning.

From the entry section 24, the flights 54 move the parts through the narrow collar 38, down the tapered portion and into the cleaning station 42 where they are submerged in the water bath contained within the upper reservoir 52. While in the water bath, the parts are passed through the ultrasonic field generated by the plurality of ultrasonic transducers 68. Within the ultrasonic field, the ultrasonic energy from the submerged ultrasonic transducers 68 passes through the water contained in the upper reservoir 52 to create a high level of ultrasonic force which cleans the manufacture parts. The high level of ultrasonic force is obtained by using a high ratio of ultrasonic power to water volume, and by locating the ultrasonic transducers 68 within the water bath of upper reservoir 52 and within at least one to three inches from the path of the parts. It is because of this high level of ultrasonic force that no detergents are necessary to achieve effective cleaning of manufacture parts.

While the parts are being exposed to the ultrasonic force generated by the ultrasonic transducers 68, they are continually moved by the flights 54 on the interior of the drum section 26 which further assists in the cleaning. As the parts are moved, different sections of the parts are exposed to the cleaning ultrasonic energy. The loose dirt or oil is then passed through the holes in the drum section 26 to the upper reservoir 52 where it is removed either by a top overflow drain as shown in FIG. 5 or a bottom flowing drain as shown in FIG. 4. The dirty water bath from the upper reservoir 52 drains directly into the dirty water reservoir 80 where it is maintained at the ideal temperature by the heating elements 106 until it is pumped through the filter system 90 and recirculated into the clean water reservoir 76. The filter system 90 may be of any variable type, as known to those skilled in the art, and constructed so as to remove a desired size of particle, such as large metal chips, or dirt. The clean water contained in the clean water reservoir 76 is then pumped by the water pump 82 into the upper reservoir 52 for further cleaning activities. Alternatively, the soiled water can be simply collected and discarded. Additional water may be pumped continuously or on a timed basis.

Upon leaving the cleaning station 42, the parts are carried by the flights 54 up the tapered portion of narrow collar 44, out of the water cleaning bath held in upper reservoir 52, and into the exiting drum section 28. The flights 54 first pass the parts through the rinsing station 92 where hot washing liquid, drawn by the electric pump 100 into the spray manifold 96, is forced through the spray nozzles 98 onto the freshly washed parts, rinsing any remaining debris. The hot washing liquid, along with any debris, is forced through the perforated drum 16 and back into the rinsing reservoir 78 where it is maintained at the ideal temperature by heating elements 104 and recirculated back into the rinsing station.

The flights 54 then carry the parts through the hot air drying section 94 where hot air drawn through the inlet duct 114 by the hot air compression system 110 and into the air heater 116 ,where it is blown through the outlet ducts 108 and onto the freshly washed and rinsed parts. The parts are then carried by the flights 54 to the end of the drum 16 where they tumble out of the drum 16 down the exit chute 118 and out the exit end 22. The cleaned parts are then carried on to the next step in the manufacturing process.

In one embodiment, the vapor generated from the washing process is recirculated into the washing system using a closed ventilation system. The run switch box is set to run an electric motor to power a compression section comprising an upper, laterally offset duct forming an inlet extending adjacent and generally parallel to the drum 16, where the duct draws off from inside the washer the hot, moist atmosphere therein surrounding the drum. A chamber in the compression section has a scroll in communication therewith, and the scroll contains a multi-bladed air rotor of the squirrel cage type which is rotatably supported therein by the electric motor in the compression section. A lower, central duct forming an outlet for the compression section discharges the moisture-laden air under pressure back into the drum section.

In another embodiment the upper reservoir 52 contains a solenoid activated drain 126 which provides for the changing of the liquid bath contained within the upper reservoir to be changed on a timed basis. As shown in FIG. 6, the upper reservoir 52 is connected directly to the filter system 90 through the solenoid drain system 126. The filter system 90 then removes unwanted particles from the cleaning liquid and recirculates the liquid back into the clean liquid reservoir 76. In this embodiment, there is no need for the dirty liquid reservoir 80 because the dirty liquid from the upper reservoir is drained directly into the filter system 90. Therefore, the filter system 90 may be placed within the area designated for the dirty liquid reservoir 78 in the description provided above. AS shown in FIG. 6, a series of side by side longitudinal heating elements 124, or a single such resistance-heating element as necessary, is fitted to the bottom of the clean liquid reservoir 76 and used to maintain the temperature of the cleaning liquid circulated into the upper reservoir 52 and into the wash cycle.

The present invention offers several advantages not available in the current ultrasonic cleaning technologies. It is one particular advantage of the present invention that no detergents are necessary to produce an effective cleaning of manufacture parts. The sole purpose of cleaning detergents used in cleaning solutions is to penetrate the dirt and oil in order to wet the underlying surface so as to allow the washing force to wash away the dirt and oil. In the present invention, such cleaning detergents are not necessary due to the high level of force generated by the ultrasonic transducers. The high level ultrasonic force is obtained by using a high ratio of ultrasonic power to liquid volume, and locating the ultrasonic transducers within the water bath to which the parts are submerged and within at least one-quarter to three inches from the path of the parts. An increased water temperature assists, as expected, in the cleaning process by thinning out the oil and dirt through reduction of viscosity. This speeds up the rate of cleaning and expands the area of application, but it is not necessary to the process. Good cleaning of soils can be done at ambient temperatures, but in practice, a high rate of cleaning can be achieved by raising the temperature of the water.

Investigations have revealed some of the parameters helpful for this process of cleaning without solvents or detergents. One is that since no solvents or detergents are used, water temperature can be used which are incompatible with some such chemicals, many of which cannot be used about 150° F. With this process, good results can be obtained with water temperatures from 135° F. to 195° F., with the preferred temperature being in the range of about 165° F. A density of ultrasonic energy in the water bath of between 5 and 15 watts per square inch, or 50 to 400 watts per gallon of water is preferred.

It has also been found to be helpful that the parts to be cleaned are in motion. It is not certain if the mild tumbling of the parts or just the simple motion of the parts past the ultrasonic transducer is responsible for the effect, but moving parts are cleaned better than stationary ones. The speed of movement is not particularly critical as long as the time the part resides in the cleaning area, i.e. the dwell time, is satisfactory for the cleaning. Dwell times in the range of about 6 to 18 minutes are preferred.

EXAMPLES

To explore the effectiveness of the method and apparatus described here to clean parts without "chemistry," i.e. solvents, detergents or other chemicals, a series of cleaning tests were conducted using a variety of categories of soils and parts.

The soils chosen are listed in the following Table 1, typical of soils found on manufactured parts.

TABLE 1

| |
|---|
| 5W 30 Motor Oil |
| Extra Virgin Olive Oil |
| Oak #50-5 Cutting Oil |
| Fuchs Reno Cut #2308 20AW Cutting Oil |
| Chem-Ecol #1000HC Cutting Oil |
| Vista LPA Solvent |
| Balsamic Vinegar |
| Baby Oil |
| SAE 50 Motor Oil |
| 100% Pure Canola Oil |
| Graphite-based Moly Grease |
| Paraffin Based Welding Tip Grease |
| Lithium Grease |
| Lubriplate #930-2 Multi-Purpose White Grease |

A representative set of parts for cleaning was also chosen. The parts selected needed to reflect differences in geometry as well as differences in materials, hardness and breakability. The parts chosen are listed in Table 2.

TABLE 2

| |
|---|
| S/S Union with Pipe Plug |
| Cork Washer |
| Rubber washer-black-soft |
| Rubber washer-blue-hard |
| Rubber washer-red-soft |
| Clear Soft Plastic Tube with Blind Hole |
| UHMW Type Plastic Tube with Blind Hole |
| Anodized Aluminum Dog Tag |
| Nylon Screw |
| Flashlight bulb and other light bulbs |

Testing was conducted on the list of soils from Table 1 using the compound part (the union) as well as testing of various of the parts from Table 2 with a difficult soil. The test sets were run on different days, and the results proved reproducible day to day.

The test of cleanliness used was a white glove test using literally gloves, cotton swabs or white linen cloth. The parts were wiped and the fresh white materials judged for soiling.

The following Table 3 summarizes some of the data obtained, averaging 100–200 samples per part. The results are given in the percentage of cleanliness of the parts. The tests were conducted in pure water heated at 160° F.

TABLE 3

| Part | 10W 30 Motor Oil | Reno Cut | Oak 50-5 Cutting Oil | Lithium Grease |
|---|---|---|---|---|
| Cork Washer | 100% | 100% | 100% | 100% |
| Rubber washer-black | 100% | 100% | 100% | 100% |
| Rubber washer-blue | 100% | 80% | 100% | 100% |
| Rubber washer-red | 100% | 100% | 100% | 75% |
| Clean Soft Tubing | 100% | 100% | 100% | 100% |
| UHMW Tube | 100% | 100% | 100% | 100% |
| Dog Tag | 100% | | | 100% |
| Nylon Screw | 100% | | | 70% |
| Light bulb | 100% | | | 100% |

The process proved gentle and thorough enough that molybdenum grease could be cleaned from light bulbs to complete cleanliness without breaking any of the bulbs.

The testing was continued by testing all the soils of Table 1 on a compound part using pure water heated to 135° F., except that 195° F. water was used for lithium grease and white grease. Complete (100%) cleaning was obtained for all soils.

Tests were also conducted to determine the parameters of the relationship between the ultrasonic transducers and the parts being cleaned. A test apparatus was used in which the distance between the transducers and the part could be varied in a bath of 5 to 6 gallons of hot pure water. It was determined that maximum cleanliness could be achieved when the distance between the transducers and the parts was between 0.25 and 2.75 chines and wherein the parts were exposed to the ultrasonic treatment for between about six and eighteen 30 minutes, in 165° F. water. This was done using a 500 watt ultrasonic transducer, leading to a calculated range of density of ultrasonic energy of about 100 watts per gallon. Parts moving during their exposure to ultrasonic energy were cleaned better than parts that remained static.

Those results demonstrated that by proper positioning of ultrasonic transducers and a moving stream of parts, ultrasonic cleaning of parts can be achieved in pure water without solvents or detergents.

I claim:

1. A continuous ultrasonic parts washing apparatus comprising:

an elongated cylindrical drum having flights on an interior surface thereof and including an entry section, a cleaning station and an exit section, the entry section and the exit section being located on opposite sides of the cleaning station such that turning of the drum will cause parts to be conveyed from the entry section through the cleaning station to the exit section, the drum being perforated so that air and water may pass through it;

a reservoir containing a liquid bath located beneath the drum arranged so that at least a portion of the cleaning station of the drum is submerged within the liquid bath;

a motor to rotate the drum; and one or more ultrasonic transducers located inside the drum coupled to the liquid bath and placed at least one inch or more from the parts so as to convey ultrasonic energy to the parts contained within the cleaning station of the drum to provide ultrasonic cleaning of the parts contained within that drum.

2. The continuous ultrasonic parts washing apparatus of claim 1, wherein the drum portion is made of a perforated metal.

3. The continuous ultrasonic parts washing apparatus of claim 1 further including a rinse station comprising one or more spray nozzles spraying a hot liquid spray upon the exit section of the drum, a rinsing reservoir wherein the hot liquid spray is collected, heated and recirculated, and a pump for recirculating the collected hot liquid from the rinsing reservoir back into the spray nozzles.

4. The continuous ultrasonic parts washing apparatus of claim 1 further including a hot air drying station comprising one or more outlet ducts for delivering hot air on the exit section of the drum, one or more inlet ducts for collecting the hot air impinged upon the small parts by the outlet ducts, a compression system for collecting the hot air through the inlet ducts wherein said compression system forces the hot air through the outlet ducts, and a heater for heating the hot air collected by the compression system.

5. The continuous ultrasonic washing apparatus of claim 1, wherein said reservoir includes a drain system selected from the group consisting of an overflow drain and a bottom flowing drain.

6. The continuous ultrasonic washing apparatus of claim 5, further including a solenoid for releasing the liquid bath in the upper reservoir through the drain system on a timed basis.

7. A method of washing parts comprising submerging parts in a water bath coupled to an ultrasonic force wherein the ultrasonic force is generated by one or more ultrasonic transducers placed away from the parts such that the parts are not in mechanical contact with the ultrasonic transducers, and applying sufficient intensity of ultrasonic energy to the parts to clean the parts without the need for solvents or detergents.

8. A method as claimed in claim 7 wherein the ultrasonic transducers are located between about one-quarter and two and three quarters inches from the parts.

9. A method as claimed in claim 7 wherein the ultrasonic transducers are located about one inch from the parts.

10. A method as claimed in claim 7 wherein the ultrasonic transducers are placed between about one-quarter and six inches away from the parts.

11. A method of washing parts comprising the steps of operating a rotating drum elongated upon a longitudinal axis which conveys parts in the drum generally along the axis as the drum rotates;

delivering parts to be cleaned into the drum;

locating beneath the drum a water reservoir such that at least a portion of the drum is submerged in the water in the reservoir;

actuating at least one ultrasonic transducer located inside of the drum coupled to the water in the reservoir so that the ultrasonic energy coupled by the water to the parts inside of the drum is effective to clean the parts in the drum without the use of solvents or detergents.

12. A method as claimed in claim 11 wherein the transducer is located between about one-quarter and about two and three quarter inches from the parts in the drum.

13. A method as claimed in claim 11 wherein the parts are exposed to the ultrasonic energy for a time period between of about six to eighteen minutes.

14. A method of cleaning parts without solvents or detergents comprising the steps of providing an apparatus with an ultrasonic transducer in a water bath;

moving the parts to be cleaned through the water bath;

wherein the moving parts pass between about one quarter and two and three quarters inch from the transducer.

15. A method as claimed in claim 14 wherein the moving parts pass about one inch from the transducer.

16. A method as claimed in claim 14 wherein the parts are exposed to the ultrasonic transducer for between about six and eighteen minutes.

17. A method as claimed in claim 14 wherein the water bath is heated to between 135° F. and 195° F.

* * * * *